United States Patent [19]

Effenberger et al.

[11] Patent Number: 4,610,918

[45] Date of Patent: Sep. 9, 1986

[54] NOVEL WEAR RESISTANT FLUOROPOLYMER-CONTAINING FLEXIBLE COMPOSITES

[75] Inventors: John A. Effenberger; Robert C. Ribbans, III, both of Bennington, Vt.; Frank M. Keese, Hoosick Falls, N.Y.

[73] Assignee: Chemical Fabrics Corporation, Merrimack, N.H.

[21] Appl. No.: 599,765

[22] Filed: Apr. 13, 1984

[51] Int. Cl.[4] ..... B32B 27/00

[52] U.S. Cl. ..... 428/245; 428/246; 428/247; 428/251; 428/256; 428/262; 428/268; 428/421; 428/422

[58] Field of Search ..... 428/421, 422, 289, 290, 428/245, 246, 256, 262, 284, 286, 251, 268

[56] References Cited

U.S. PATENT DOCUMENTS

| | | | |
|---|---|---|---|
| T884008 | 3/1971 | Gumerman | 428/422 |
| T952005 | 11/1976 | Attwood et al. | 525/189 |
| T988008 | 11/1979 | Mayor et al. | 525/537 |
| 2,681,324 | 6/1954 | Hochberg | 260/29.6 |
| 2,710,266 | 6/1955 | Hochberg | 260/29.6 |
| 3,455,774 | 7/1969 | Lindsey et al. | 428/422 |
| 3,579,370 | 5/1971 | Punderson et al. | 428/422 |
| 3,616,177 | 10/1971 | Gumerman | 428/422 |
| 3,642,569 | 2/1972 | Gerow | 428/422 |
| 3,970,627 | 7/1976 | Seymus | 428/422 |
| 3,981,945 | 9/1976 | Attwood et al. | 428/422 |
| 3,986,993 | 10/1976 | Vassiliou | 428/422 |
| 3,993,843 | 11/1976 | Vasta | 428/422 |
| 4,011,361 | 3/1977 | Vassiliou et al. | 428/422 |
| 4,016,125 | 4/1977 | Vassiliou et al. | 428/421 |
| 4,017,555 | 4/1977 | Alvarez | 260/857 |
| 4,039,497 | 8/1977 | Troussier et al. | 428/422 |
| 4,039,713 | 8/1977 | Vassiliou | 428/422 |
| 4,049,863 | 9/1977 | Vassiliou | 428/422 |
| 4,054,705 | 10/1977 | Vassiliou | 428/422 |
| 4,066,183 | 1/1978 | Armstrong | 428/422 |
| 4,070,525 | 1/1978 | Vassiliou et al. | 428/422 |
| 4,087,394 | 5/1978 | Concannon | 260/857 |
| 4,100,113 | 7/1978 | McCain | 428/422 |
| 4,113,912 | 9/1978 | Okita | 428/422 |
| 4,122,226 | 10/1978 | Vassiliou | 428/187 |
| 4,123,401 | 10/1978 | Berghmans et al. | 428/463 |
| 4,131,711 | 12/1978 | Attwood | 428/422 |
| 4,139,576 | 2/1979 | Yoshimura et al. | 260/857 |
| 4,156,049 | 5/1979 | Hodes et al. | 428/422 |
| 4,157,273 | 6/1979 | Brady | 428/421 |
| 4,169,117 | 9/1979 | Vasta | 428/422 |
| 4,177,320 | 12/1979 | Yoshimura et al. | 428/422 |
| 4,180,609 | 12/1979 | Vassiliou | 428/422 |
| 4,212,923 | 7/1980 | Brady | 428/422 |
| 4,228,219 | 10/1980 | Hoy et al. | 428/422 |
| 4,278,776 | 7/1981 | Mauro et al. | 525/178 |
| 4,284,668 | 8/1981 | Nixon | 428/422 |
| 4,287,112 | 9/1981 | Berghmans | 428/422 |
| 4,335,030 | 6/1982 | Concannon | 428/422 |
| 4,335,238 | 6/1982 | Moore et al. | 428/421 |
| 4,339,565 | 7/1982 | Tomoda | 528/27 |
| 4,395,445 | 7/1983 | Gebauer et al. | 428/422 |
| 4,399,183 | 8/1983 | Withers | 428/422 |
| 4,401,711 | 8/1983 | Silva et al. | 428/422 |
| 4,421,878 | 12/1983 | Close | 428/422 |

*Primary Examiner*—James J. Bell

*Attorney, Agent, or Firm*—Brumbaugh, Graves, Donohue & Raymond

[57] ABSTRACT

Fluoropolymer containing coatings are applied to substrates, preferably textile substrates, to obtain composites which are flexible and not brittle, and which exhibit a low coefficient of friction, good wear resistance and excellent release properties. This invention comprises the technique of initially coating a flexible substrate, such as glass fabric or a metal mesh, with a fluoropolymer, which serves to prevent cracking upon flexing. The precoated substrate is thereafter coated with a blend of a hard polymer and a fluoropolymer which adheres well to the pre-coated intermediate substrate. Significantly, the composites of the invention are flexible, yet possess the wear resistance of the hard polymer component as well as the frictional and release characteristics of the fluoropolymer components.

8 Claims, No Drawings

NOVEL WEAR RESISTANT FLUOROPOLYMER-CONTAINING FLEXIBLE COMPOSITES

BACKGROUND OF THE INVENTION

This invention relates to new fluoropolymer containing composites having improved wear resistance characteristics. More particularly, the invention relates to coatings useful in the manufacture of composites which are both flexible and resistant to wear and abrasion. The invention further relates to a novel method for preparing such composites whereby the wear characteristics of relatively hard polymers are imparted to composites, such as woven textile composites, without substantial loss of flexibility.

Perhaps the most well-known subclass of fluoropolymers are substances called "fluoroplastics" which are generally recognized to have excellent electrical characteristics and physical properties, such as a low coefficient of friction, low surface free energy and a high degree of hydrophobicity. Fluoroplastics, and particularly perfluoroplastics (i.e., those fluoroplastics which do not contain hydrogen), such as polytetrafluoroethylene (PTFE), fluoro (ethylenepropylene) copolymer (FEP) and copolymers of tetrafluoroethylene and perfluoropropyl vinyl ether (PFA), are resistant to a wide range of chemicals, even at elevated temperatures, making them widely useful in a variety of industrial and comestic applications. The broad class of fluoropolymers also includes substances called "fluoroelastomers" which are not only elastomeric, but possess to a lesser degree several of the aforementioned physical and electrical properties of a fluoroplastic. Fluoroelastomers, including perfluoroelastomers, however, have a low flex modulus and conformability which is lacking in the more crystalline fluoroplastics.

Fluoropolymers, such as polytetrafluoroethylene, are also well-known for their low coefficient of friction and relatively low surface-free energy which contributes to release behavior. While they exhibit outstanding chemical and thermal resistance, they are soft waxy materials with fragile surfaces easily damaged mechanically by scratching or wearing when rubbed against other materials. It is for these reasons that cookware and other metal surfaces requiring non-stick and/or low friction frequently employ coatings that are combinations of PTFE and relatively harder polymers. Increasing proportions of the harder polymer component in the coating matrix can lead to improved wear characteristics, but with an attendant loss of elongation (embrittlement). While such coating compositions may be reasonably employed on relatively rigid substrates, such as those normally used on coated bakeware, when coated directly onto flexible substrates, such as woven cloth, they result in composites which are most frequently too brittle to serve as flexible products, and even crack when folded upon themselves.

Accordingly, it is an object of this invention to provide a fluoropolymer containing coating for a flexible substrate which will retain its flexibility, exhibit good internal matrix cohesion and substrate to matrix adhesion, and yet possess the improved wear resistant characteristics of the relatively harder polymer coatings, including blends with PTFE.

It is also an object of this invention to provide a fluoropolymer-containing composite which is flexible and possesses good surface wear characteristics, and with the outstanding frictional and release properties of a fluoropolymer.

It is a further object of this invention to provide a method for preparing fluoropolymer-containing composites which exhibit outstanding wear characteristics and a low coefficient of friction.

SUMMARY OF THE INVENTION

In accordance with the invention, fluoropolymercontaining coatings are applied to substrates, preferably textile substrates, to obtain composites which are flexible and not brittle (i.e. they may be folded upon themselves without breaking), and which exhibit a low coefficient of friction, good wear resistance and excellent release properties. This invention comprises the technique of initially coating a flexible substrate, such as glass fabric or a metal mesh, with a fluoropolymer, such as polytetrafluoroethylene (PTFE), prior to the application of an additional layer containing a polymer capable of imparting wear resistance to the finished composite. This technique has been found to prevent the wear-resistant invention composites from cracking upon flexing. The initially coated substrate is thereafter coated with a blend or dispersion of a harder polymer and a fluoropolymer dispersion, such as PTFE, which adheres well to the intermediate coated substrate. The resulting composites are not brittle and exhibit satisfactory flexibility. Significantly, the composites of the invention are flexible yet possess the wear and abrasion resistance associated with the harder polymer component in addition to the good frictional and release characteristics of the fluoropolymer component.

The novel textile composites according to the invention include a substrate, preferably a flexible, textile substrate, coated on one or both faces with a matrix comprising:

(A) an initial fluoropolymer-containing layer, preferably comprising a fluoroplastic, a fluoroelastomer, or blends or combinations thereof; and (B) an overcoat layer comprising a blend of (1) a polymeric material capable of imparting wear resistance to the finished composite, hereinafter referred to as "hard polymer", and (2) a fluoroplastic, fluoroelastomer or any blend or combinations thereof wherein the fluoropolymer component comprises about 40–90% by weight, preferably about 60 to 80% by weight, of the hard polymer/fluoropolymer blend.

In those embodiments where the overcoat layer on element B, as described above, is separately formed as a film for subsequent transfer to the substrate, the initial layer, or element A as described above, may be other than fluoropolymer-containing. Examples of such composites are described in the copending application of Effenberger and Ribbans, Ser. No. 599,766, also filed Apr. 13, 1984. In those embodiments, the critical layers may comprise any suitable adhesion promoting polymer or chemical which is compatible with the substrate and capable of effecting a bond between the most proximate polymers of any additional layer, including element B above, and itself.

Any suitable reinforcement material capable of withstanding processing temperatures may be employed as a substrate in accordance with the invention. Examples include, inter alia, glass, fiberglass, ceramics, graphite (carbon), PBI (polybenzimidazole), PTFE, polyaramides, such as KEVLAR and NOMEX, metals including metal wire or mesh, polyolefins such as TYVEK, polyesters such as REEMAY, polyamides, polyimides, thermoplastics such as KYNAR and TEFZEL, polyether sulfones, polyether imide, polyether ketones, novoloid phenolic fibers such as KYNOL, cotton, asbestos and other natural as well as synthetic fibers. The substrate may comprise a yarn, filament, monofilament or other fibrous material either as such or assembled as a textile, or any woven, non-woven, knitted, matted, felted, etc. material.

Depending upon the nature of the substrate and the intended end use of the composite, the reinforcement or substrate may be impregnated, either initially or simultaneously with the initial polymer layer, with a suitable lubricant or saturant, such as methylphenyl silicone oil, graphite, or a highly fluorinated fluid lubricant. The lubricant or saturant performs three functions vis-a-vis the reinforcing substrate:

(1) As a lubricant, it protects the substrate from self-abrasion by maintaining the mobility of the reinforcing elements;

(2) As a saturant, it inhibits extensive penetration of the initial polymer coat into the substrate which could reduce flexibility; and (3) In a finished product, it remains in the substrate to inhibit wicking of moisture or other degrading chemicals through the substrate. The lubricant or saturant may either be applied separately as an initial pass or in combination with the first application of polymeric component.

Alternatively, again depending upon the nature of the substrate and the envisioned end use, the reinforcement or substrate may be treated with a bonding or coupling agent to enhance adhesion of the reinforcement to the most proximate matrix polymers.

DETAILED DESCRIPTION

The initial layer, described as element A above, is applied to facilitate adhesion of the matrix to the substrate while minimally contributing to the stiffness of the final composite. Layer A may comprise one or more components so long as the resulting intermediate remains flexible and bondable to element B. In some embodiments, openings may remain in the substrate to enhance flexibility after application of the overcoat layer or layers. Fluoroploymers suitable for the initial layer are characterized by relatively low modulus and are preferably fluoroplastics, such as PTFE, or fluoroelastomers, such as VITON or KALREZ (DuPont), AFLAS (Asahi), KEL-F (3M), or any blend thereof.

The initial coating is then covered with a layer or layers of a blend of a hard polymer and a fluoropolymer, such as fluoroplastic, fluoroelastomer, or any blend or combination thereof. Preferably, this portion of the matrix includes a layer or layers of a blend containing the hard polymer and the fluoropolymer in such proportions so as to impart any desired balance of known fluoropolymer properties and hard polymer characteristics, particularly wear resistance, to the composite.

Where the element B layer is to be applied as a separate film laminated to the substrate, the initial layer is any adhesion promoting polymer, such as intially uncured rubbers, silicones, urethanes, soft acrylics or chemicals; such as silane or titanate coupling agents, or any composition compatible with the substrate and capable of effecting a bond between the most proximate components of the element B layer and itself.

It has been found that through the selection of the layer A and the layer B, particularly employing the hard polymer/fluoropolymer blends according to the invention, adequate cohesion within the matrix itself and adhesion of the matrix to the substrate may be achieved by thermal means alone, if so desired, without any physical or chemical treatment of the substrate or individual matrix layers and without the use of adhesion promoters. Through the use of the invention matrix and the particular deployment of the layers thereof vis-a-vis each other and the substrate in accordance with the invention method, the ability to maintain an excellent degree of adhesion is achieved, while maintaining flexibility and the desired properties of the different fluoropolymer and hard polymer components of the matrix.

The overcoat layer, element B, comprises a wear resistant fluoropolymer composition, preferably containing a perfluoropolymer, modified with hard polymeric fillers to improve wear characteristics. Examples of such hard polymers include, polyphenylene sulfide, polyimide, epoxy, polyamide imide, polyether sulfone, polyether ketone, polyether imide, polyesters and any other known hard polymers suitable for improving wear characteristics of a coating.

The coating layers of the invention matrix may be applied by dip coating from an aqueous dispersion. Any conventional method, such as spraying, dipping, and flow coating, from aqueous or solvent dispersion, calendering, laminating and the like, followed by drying and baking, may be employed to form the coating, as is well-known in the art. As previously disclosed, the coating layers may be separately formed as films of one or more layers for subsequent combination with the substrate.

The term "fluoroplastic" as used herein shall encompass both hydrogen-containing fluoroplastics and hydrogen-free perfluoroplastics, unless otherwise indicated. Fluoroplastic means polymers of general paraffinic structure which have some or all of the hydrogen replaced by fluorine, including inter alia polytetrafluoroethylene (PTFE), fluorinated ethylene propylene (FEP) copolymer, perfluoroalkoxy (PFA) resin, homopolymers of polychlorotrifluoroethylene (PCTFE) and its copolvmers with TFE or $VF_2$, ethylene-chlorotrifluoroethylene (ECTFE) copolymer and its modifications, ethylene-tetrafluoroethylene (ETFE) copolymer and its modifications, polyvinylidene fluoride (PVDF), and polyvinylfluoride (PVF).

Similarly, the term "fluoroelastomer" as used herein shall encompass both hydrogen-containing fluoroelastomers as well as hydrogen-free perfluoroelastomers, unless otherwise indicared. Fluoroelastomer means any polymer with elastomeric behavior or a high degree of compliance, and containing one or more fluorinated monomers having ethylenic unsaturation, such as vinylidene fluoride, and one or more comonomers containing ethylenic unsaturation. The fluorinated monomer may be a perfluorinated mono-olefin, for example hexafluoropropylene, penta-fluoropropylene, tetrafluoroethylene, and perfluoroalkyl vinyl ethers, e.g. perfluoro (methyl vinyl ether) or (propyl vinyl ether). The fluorinated monomer may be a partially fluorinated mono-olefin which may contain non-fluorine substituents, e.g. chlorine or hydrogen. The mono-olefin is preferably a straight or branched chain compound having a terminal ethylenic double bond. The elastomer preferably consists of units selected from the previously mentioned fluorine-containing monomers and may include other non-fluorinated monomers, such as olefins having a terminal ethylenic double bond, especially ethylene and propylene. The elastomer will normally consist of carbon, hydrogen, oxygen and fluorine atoms.

Any fluoropolymer component may contain a functional group such as carboxylic and sulfonic acid and salts thereof, halogen, as well as a reactive hydrogen on a side chain.

Preferred elastomers are copolymers of vinylidene fluoride and at least one other fluorinated monomer, especially one or more of hexafluoropropylene, pentafluoropropylene, tetrafluoroethylene and chlorotrifluoroethylene. Available fluoroelastomers include copolymers of vinylidene fluoride and hexafluoropropylene, and terpolymers of vinylidene fluoride, hexafluoropropylene and tetrafluoroethylene, sold by DuPont as VITON and by 3M as FLUOREL and by Daiken as DAIEL. Additionally, elastomeric copolymers of vinylidene fluoride and chlorotrifluoroethylene are available from 3M as Kel-F. The use of AFLAS, which is a copolymer of TFE and propylene, as manufactured by Asahi, is also contemplated.

Preferred perfluoroelastomers include elastomeric copolymers of tetrafluoroethylene with perfluoro alkyl comonomers, such as hexafluoropropylene or perfluoro (alkyl vinyl ether) comonomers represented by

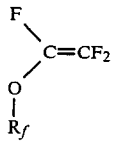

in which $R_f$ is a perfluoroalkyl or perfluoro (cyclo-oxa alkyl) moiety. Particularly preferred are the perfluorovinyl ethers in which $R_f$ is selected from the groups $-CF_3$, $-C_3F_7$,

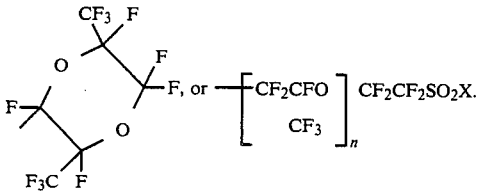

where n=1–4 and X=H, Na, K or F. Particularly contemplated is KALREZ which is a copolymer including TFE and perfluoromethylvinyl ether (PMVE).

The term "polyimide" as used herein encompasses $$=N-R_1-N=R_2=$$

where $R_1$ is a diamide and $R_2$ is a dianhydride.

The term polyamidimide as used herein encompasses $$-\underset{H}{N}-R_1-N=R_2$$

wherein $R_1$ and $R_2$ have the same meaning as above.

If desired, and as is well-known in the art, fillers or additives such as pigments, plasticizers, stabilizers, softeners, extenders, and the like, can be present in the matrix composition. For example, there can be present substances such as graphite, carbon black, titanium dioxide, alumina, alumina trihydrate, glass fibers, beads or microballoons, carbon fibers, magnesia, silica, asbestos, wollastonite, mica, and the like.

In a preferred embodiment, the formation of the coated matrix layers upon the substrate is essentially accomplished in accordance with the invention by a method which comprises the steps of:

1. If necessary or desired, removing the sizes or finishes from the textile substrate material, for example, in the instance of woven fiberglass, by heat cleaning the substrate or scouring a woven synthetic fabric;

2. Initially coating the substrate with a low modulus polymer layer, particularly, a fluoropolymer, which may be applied to one or both faces of the substrate. The low modulus fluropolymer is preferably a perfluoropolymer, including a perfluoroplastic, such as PTFE or low cyrstallinity copolymers thereof, or a fluoroelastomer, such as KALREZ, VITON, AFLAS, or blends of such fluoropolymers. As hereinbefore discussed, a suitable saturant or lubricating agent, preferably methylphenyl silicone oil may also be applied to the substrate either initially or simultaneously with the initial polymer layer. In instances where sufficient flexibility otherwise exists, a coupling agent may be used to enhance the adhesion of the matrix to the substrate, as desired. As previously set forth, the initial coating is applied so as to minimize the stiffness of the composite and may be a relatively light application depending upon the weight and openness of the substrate. As indicated above, where the substrate is coated on only one face, the other face of the substrate may be adhered to a different coating material;

3. Applying as an overcoat layer or layers, either directly upon the intial layer or upon any desired intermediate layer, a blend of (1) a hard polymer and (2) a fluoroplastic, a fluoroelastomer, or any blend or combination thereof; and 4. Further applying, as desired, any optional topcoat layer or layers which do not substantially diminish the flexible or wear resistance features of the composite, such as a thin top coating of PTFE or a selected fluoroelastomer.

The composites of the present invention may be produced, if so desired, by aqueous dispersion techniques. The process may be carried out under the conditions by which the cohesiveness of the matrix and adhesion to the substrate is thermally achieved. A preferred process for the manufacture of invention composites comprises an initial application of a low modulus fluoropolymer from a latex or dispersion to a suitably prepared substrate at temperatures leading to fusing or consolidation of the applied polymer. Following this initial coat, any optional intermediate layer and the overcoat layer comprising a blend of hard polymer and perfluoropolymer derived from a latex or dispersion, is applied in such a manner as to dry the coating, but not to exceed the upper temperature limits of its most thermally labile resinous component. The resulting, partially consolidated coating layers may then be subjected to more modest heat under pressure to further consolidate or strengthen the applied coating. Calendering is a convenient process to achieve this result. Any desired topcoat may then be applied. Thereafter, the composite is subjected to a temperature consistent with that required for fusion of the matrix component with the highest melting point to complete consolidation with minimal heat exposure.

The following additives may be included in the process for formulating the composition of the outermost coating layer: a surface active agent such as an anionic active agent or a non-ionic active agent; a creaming agent such as sodium or ammonium alginate; a viscosity-controlling agent or a thickener such as methyl cellulose or ethyl cellulose; a wetting agent such as a fluorinated alkyl-carboxylic acid, an organic solvent, or sulfonic acid; or a film former.

The invention and its advantages are illustrated, but are not intended to be limited, by the following examples. The examples illustrate composites employing a variety of substrates and coating matrices contemplated by the invention. The test procedures used for the chemical and physical testing and property determinations for the composites prepared according to the invention and the controls are identified below:

| PROPERTY | | TEST PROCEDURE |
|---|---|---|
| Weight (oz/sq yd) | | FED STD 191-5041 |
| Thickness (ins) | | FED STD 191-5030 |
| Tensile Strength (lbs/in) | Warp<br>Fill | FED STD 191-5102 |
| Tensile Strength after fold (lbs/in) (or Flex Fold) | Warp<br>Fill | * |
| Trapezoidal Tear (lbs) Strength | Warp<br>Fill | FED STD 191-5136 |
| Coating Adhesion (lbs/in) | Dry<br>Wet | ** |
| Dielectric Strength (volts) | | ASTM D-902 |
| Wear Rate (Rotating Ring Wear Test) | | ASTDM D-3702 |

*This is a comparative flex-fold test whereby a rectangular test specimen (long dimension parallel to warp yarns in the "warp test" and parallel to filling yarns in "fill test") is folded at its center, rolled with a weighted roller, ten times, and tested as per G.S.A. 171 #5102. The test values are compared with tensile values for an unfolded specimen. Fold resistance is reported as percent of strength retained after the fold. (In the examples which follow, the results are expressed in actual tensile strength after folding, and the percent retention is not calculated.)

**This test measures the adherance of the coating matrix to a substance by subjecting a specimen (prepared from two pieces of the sample composite joined face to face as in making a production type joint or seam) to an Instron Tester, Model 1130, whereby the pieces forming the specimen are separated for a specified length (3") at a specified rate of strain (2"/min.). The average reading during separation is deemed the adhesion value in lbs./in.

This invention applies to a variety of hard polymers, fluoropolymer and perfluoropolymer combinations coated onto a variety of textile substrates. The following examples describe in detail experiments run and results observed with some of the contemplated composites according to the invention and are not meant to limit the scope of this invention in any way. Although glass fabrics were used for experimentation, it should be understood that the invention applies to any textile substrate capable of being coated via conventional dip coat processing or the method set forth in the copending application of Effenberger and Ribbans, Ser. No. 599,766, filed Apr. 13, 1984.

EXAMPLE I

Style 2113 glass fabric (greige weight 2.38 oz/sq yd) was treated with an aqueous dispersion based on Xylan 8330/I (Whitford Corp., West Chester, PA.). It is a product containing particles up to 10 microns in size of PTFE and polyphenylene sulfide (PPS) dispersed in water and containing a small amount of black pigment. The coating was dried at ca. 200° F. and cured at ca. 700° F.

The resulting coated fabric weighed 2.6 oz/sq yd and even at this low weight it fractured when creased. It also exhibited very poor tear strength.

EXAMPLE II

Style 2113 glass fabric (Greige weight 2.38 oz/sq yd) was given two coats of a 60% solids PTFE dispersion (designated TE-3313 and available from Dupont). It was then coated three times with a 50:50 (by volume) blend of TE-3313 and Xylan 8330/I. A final coat of PTFE derived from TE-3313 was then applied over the Xylan/PTFE coatings. Upon each coating the fabric was dried and fused at temperatures up to ca. 700° F. The resulting coated fabric weighed 5.6 oz/sq yd. It was quite flexible and could be repeatedly creased without breaking. The trapezoidal tear strength was measured at 8.5×1.1 lbs (warp x fill) and the coating adhesion was measured at 9.9 lbs/inch. The composite exhibited good tear strength and the coating was well adhered to the substrate.

EXAMPLE III

Three composites based upon Style 128 glass fabric (6.0 oz/sq yd greige weight) were prepared for wear testing. One was coated only with PTFE dispersion. The other two were first coated with two layers of PTFE dispersion. One of them was subsequently coated with a blend of TE-3313 and Xylan 8330/I comprising a 75.3% PTFE/24.7% PPS (polyphenylene sulfide) mixture, by weight. The other was coated with a 55.3% PTFE/44.7% PPS weight blend of a TE-3313/Xylan 8330 I. All coatings were applied and cured using a coating tower. All three fabric samples were tough and flexible and could be creased repeatedly without breaking. They were subjected to the Rotating Ring Wear Test which generated relative wear values. The values obtained showed that the PTFE/PPS based composites exhibited significantly less wear than the 100% PTFE based composite.

| Sample | Wear Value |
|---|---|
| 100% PTFE | 2300 |
| 75.3% PTFE/24.7% PPS | 280 |
| 55.3% PTFE/44.7% PPS | 1500 |

EXAMPLE IV

Two composites based upon Style 128 glass fabric (6.0 oz/sq yd greige weight) were prepared for testing. One was prepared by four applications of a mixture of Xylan 3200 and Teflon TE-3313 with fusion of the resins at 700° F. after the final application. Xylan 3200 is a water compatible formulation of a polyester polymer. The blend contained 60.9% PTFE and 39.1% polyester, by weight. The other composite sample was prepared by two applications of TE-3313 followed by four applications of the Xylan/TE-3313 blend. Both composite samples were dried and cured at ca. 700° F. The composite sample prepared with two initial applications of PTFE was tough and flexible, while the composite prepared using only the 60.9% PTFE/39.1% polyester blend, by weight, and lacking the initial PTFE coatings was brittle and broke upon repeated creasing. The tensile strength of the PTFE precoated composite was initially 350 lbs/in. A 40% drop in tensile strength occurred after folding in accordance with the Flex Fold test. The tensile strength of the composite sample lacking the initial PTFE application was initially 560 lbs/in. After folding in accordance with the Flex Fold test, it experienced a 73% drop in tensile strength.

Both composites were tested in an MIT folding endurance tester. The fabric without the initial PTFE application tested to 4100×7700 folds to failure (warp x fill), while the composite with the PTFE pre-coats tested to 76000×61000 folds to failure (warp x fill).

EXAMPLE V

A flexible composite based upon Style 128 fabric was prepared by an initial apblication of two coats of PTFE dispersion followed by five applications of a blend of Xylan 3400 and TE-3313 to one side only. This blend contained 50% by weight PTFE and 50% by weight of a polyamide-imide based upon solids. The initial application of PTFE was conducted at temperatures up to 590° F. The subsequent coats containing the PTFE/-polyamide-imide blend were each fused at 700° F.

The resulting flexible composite was more abrasion resistant than a similar composite containing only PTFE. It was subjected to 10,000 cycles on a Model 503 Tabor Abrader, using a 250 gm wt. and CF-10 abrasion wheels. Samples were weighed before and after abrasion. Three determinations of weight gain for the wear resistant composite indicated an average gain of 0.7 milligrams. Samples of an otherwise similar composite based upon PTFE alone were also tested. They lost an average of 6.9 milligrams. These data show substantial improvement in wear resistance for a flexible PTFE/-polyamide-imide composite.

EXAMPLE VI

Style 2113 fiberglass fabric was treated with an aqueous emulsion of methyl phenyl silicone oil derived from ET-4327 (Dow Corning) by dilution of 1.5 grams of ET-4327 with 20 grams of water. The fabric so treated was then flexibilized by coating it with PTFE derived from an aqueous dispersion of TE-3313 (Dupont) with a specific gravity of 1.35. This flexible fabric was then overcoated with a blend of PTFE and PPS derived from TE-3313 and Xylan 8330/I (Whitford) respectively, applied in two identical steps.

The final product had a thickness of 4.4 mils and a weight of 4.25 oz/yd$^2$. It was characterized by good tear strength (10.1 lbs. warp, 3.6 lbs. fill) and a wear resistance about 5 times better than a dip-coated PTFE control.

EXAMPLE VII

A composite was prepared from Style 2116 fabric by heat-cleaning and coating with an aqueous mixture of PTFE dispersion and phenylmethylsilicone oil in aqueous emulsion such that the oil represents 8% by weight of the combined weight of PTFE solids and the oil at an overall specific gravity of 1.32. This intermediate was then coated with a highly fluorinated elastoplastic blend of PTFE and $VF_2$/HFP/TFE terpolymer, followed by six coats of a blend containing 100 pbw TE-3313, 100 pbw Xylan-3400 (containing an aromatic polyamide-imide), 100 pbw $H_2O$ and 3 pbw L-77 silicone surfactant obtained from Union Carbide. The composite was top-coated with PTFE derived from TEFLON-30 B. The properties of Example VII are listed below:

| PROPERTY | UNITS | VALUES |
|---|---|---|
| Weight | oz./yd.$^2$ | 7.67 |
| Thickness | mil. | 5.5 |
| Dielectric Strength | volts | |
| ¼ in. electrode | | 2200 |
| 2 in. electrode | | 1500 |

-continued

| PROPERTY | UNITS | VALUES |
|---|---|---|
| Trapezoidal Tear Strength | lbs. | |
| Warp | | 10 |
| Fill | | 14 |
| Tensile Strength | lbs./in. | |
| Warp | | 200 |
| Fill | | 180 |
| Coating Adhesion | lbs./in. | 3.0 |

Flexible belts prepared from this composite and used on a high speed packaging machine requiring durable release characteristics outlasted conventional belts based upon composites containing PTFE alone by a factor of at least three.

While representative applications and embodiments of the invention have been described, those skilled in the art will recognize that many variations and modifications of such embodiments may be made without departing from the spirit of the invention, and it is intended to claim all such variations and modifications as fall within the true scope of the invention.

We claim:

1. A flexible composite which comprises a flexible substrate coated on one or both faces with a matrix comprising:

(a) an initial fluoropolymer-containing layer which includes a fluoroplastic, a curative-free fluoroelastomer or blends or combinations thereof; and (b) an overcoat layer comprising a blend of (i) a hard polymer and (ii) a fluoropolymer, wherein the fluoropolymer includes a fluoroplastic, a curative-free fluoroelastomer or blends or combinations thereof and wherein said fluoropolymer may comprise from about 40 to 90 percent by weight of the blend of hard polymer and fluoropolymer.

2. A composite according to claim 1 wherein the substrate is a textile.

3. A composite according to claim 1 wherein the fluoropolymer of the initial layer is a low modulus fluoropolymer.

4. A composite according to claim 3 wherein the low modulus fluoropolymer is a perfluoroplastic, a perfluoroelastomer or any blend or combination thereof.

5. A composite according to claim 1 wherein the hard polymer is selected from the group comprising polyimides, polyamide-imide, polyphenylene sulfide, epoxy and polyether ketone, polyether imide, polyether sulfone and polyesters.

6. A composite according to claim 5 wherein the fluoropolymer comprises about 60 to 80 percent by weight of the hard polymer/fluoropolymer blend.

7. A composite according to claim 1 wherein the fluoropolymer component of the blend of the overcoat layer is selected from the group comprising fluoroplastics, fluoroelastomers, and any blend or combination thereof.

8. A flexible composite which comprises a flexible substrate coated on one or both faces with:

(a) an initial layer which comprises any suitable adhesion promoting chemical compatible with the substrate; and (b) an overcoat layer comprising a blend of (i) a hard polymer and (ii) a fluoropolymer wherein the fluoropolymer includes a fluoroplastic, a curative-free fluoroelastomer or blends or combinations thereof, wherein said fluoropolymer may comprise from about 40 to 90% by weight of the blend of hard polymer and fluoropolymer, and wherein said overcoat layer is separately formed and thereafter applied to the treated substrate.

* * * * *